US011026530B1

(12) United States Patent
Goldberg et al.

(10) Patent No.: US 11,026,530 B1
(45) Date of Patent: Jun. 8, 2021

(54) MODULAR COFFEE AND TEA PREPARATION TRAY

(71) Applicant: THE CLEAN COUNTER COMPANY, LLC, Miami, FL (US)

(72) Inventors: Seth Goldberg, Miami, FL (US); Julius Goldberg, Miami, FL (US)

(73) Assignee: THE CLEAN COUNTER COMPANY, LLC, Miami, FL (US)

( * ) Notice: Subject to any disclaimer, the term of this patent is extended or adjusted under 35 U.S.C. 154(b) by 0 days.

(21) Appl. No.: 16/805,230

(22) Filed: Feb. 28, 2020

(51) Int. Cl.
*A47G 23/03* (2006.01)

(52) U.S. Cl.
CPC ..... *A47G 23/0303* (2013.01); *A47G 23/0316* (2013.01)

(58) Field of Classification Search
None
See application file for complete search history.

(56) References Cited

U.S. PATENT DOCUMENTS 3,880,485 A * 4/1975 Schmelzer ..... A47B 3/10 312/282
4,386,703 A * 6/1983 Thompson ..... A47J 39/006 126/262
4,838,444 A * 6/1989 Bitel ..... B65D 1/36 206/518
6,752,288 B1 * 6/2004 Swift ..... A47G 23/06 220/551
9,949,584 B2 * 4/2018 Wansink ..... B65D 1/36
2003/0230582 A1 * 12/2003 Whitmore ..... B65D 43/162 220/507
2017/0021957 A1 * 1/2017 Gartz ..... B65D 1/36

* cited by examiner

*Primary Examiner* — Steven M Marsh
(74) *Attorney, Agent, or Firm* — Mark Terry

(57) ABSTRACT

A beverage preparation apparatus that includes a main tray having a first compartment configured to provide a first containment area to store a utensil component, a second compartment configured to provide a second containment area to store a first beverage component, and a third compartment configured to provide a third containment area to store a second beverage component. The main tray includes a first sidewall, a second sidewall, and a handle element. The beverage preparation apparatus also includes a first side tray for receiving a first beverage container and a second side tray for receiving a second beverage container. A first end of each side tray is configured to align flush against each sidewall. Additionally, each sidewall includes an outwardly extending semi-annular flange configured to rest above the first end of each side tray such that a gapless connection is formed between each side tray and each sidewall.

20 Claims, 8 Drawing Sheets

MODULAR COFFEE AND TEA PREPARATION TRAY

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The present invention relates to the field of kitchen and restaurant supplies, and more specifically to the field of tray systems designed for compartmentalizing and organizing the various components used while preparing a beverage.

BACKGROUND

Coffee and tea recipes have been evolving for centuries. The history of tea dates back as early as the 9th century and the history of coffee dates to about the 1600s. There are well-known rituals for the preparation of coffee and tea, which involve the use of various related accoutrements, such as tea packets, coffee grounds, sugar, spoons, mugs, etc. Consequently, there are many existing apparatuses for storing, displaying and carrying said accoutrements, including shelves, boxes, caddies and drawers. But although there are plenty of coffee and tea recipes to choose from, and there are many existing solutions for holding said accoutrements, there are no known systems that are specifically designed to contain the refuse and runoff associated with the preparation of a cup of coffee and tea, and otherwise separate and organize the various components as used during the preparation of coffee and tea beverages. As a result, there exists a need for improvements over the prior art and more particularly, for a multi-functional beverage preparation apparatus.

SUMMARY

A beverage preparation apparatus and kit are disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a beverage preparation apparatus is disclosed. The apparatus includes a main tray comprising a first compartment defined by a first set of a plurality of chamfered walls. The first compartment is configured to provide a first containment area for allowing a user to store a utensil component therein. The main tray further includes a second compartment defined by a second set of a plurality of chamfered walls. The second compartment is configured to provide a second containment area for allowing the user to store a first beverage component therein. The main tray further includes a third compartment defined by a third set of a plurality of chamfered walls. The third compartment is configured to provide a third containment area for allowing the user to store a second beverage component therein. The main tray also includes a first sidewall defined by a first curved element, a second sidewall defined by a second curved element, and a handle element. The apparatus includes a first side tray for receiving a first beverage container. The first side tray is configured to removably connect to the first sidewall of the main tray. The apparatus also includes a second side tray for receiving a second beverage container. The second side tray is configured to removably connect to the second sidewall of the main tray.

The kit includes a main tray comprising a first compartment that is configured to provide a first containment area for allowing a user to store a utensil component therein. The main tray further includes a second compartment that is configured to provide a second containment area for allowing the user to store a first beverage component therein. The main tray further includes a third compartment that is configured to provide a third containment area for allowing the user to store a second beverage component therein. The main tray also includes a first sidewall, a second sidewall, and a handle element. The kit includes a first beverage container and a first side tray for receiving the first beverage container. The first side tray is configured to removably connect to the first sidewall of the main tray. The kit also includes a second beverage container and a second side tray for receiving the second beverage container. The second side tray is configured to removably connect to the second sidewall of the main tray.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
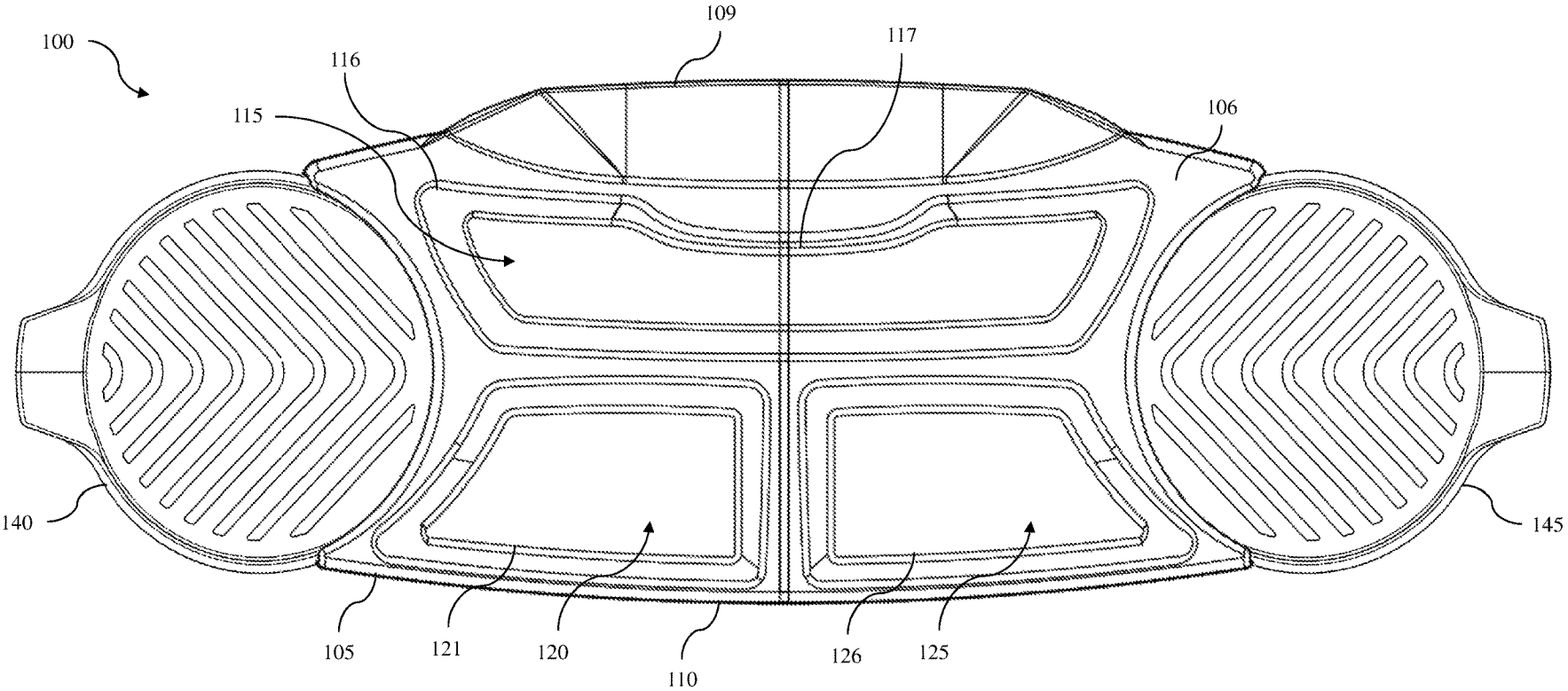
FIG. 1 is a top planar view of an assembled beverage preparation apparatus, according to an example embodiment of the present invention.
Figure 2:
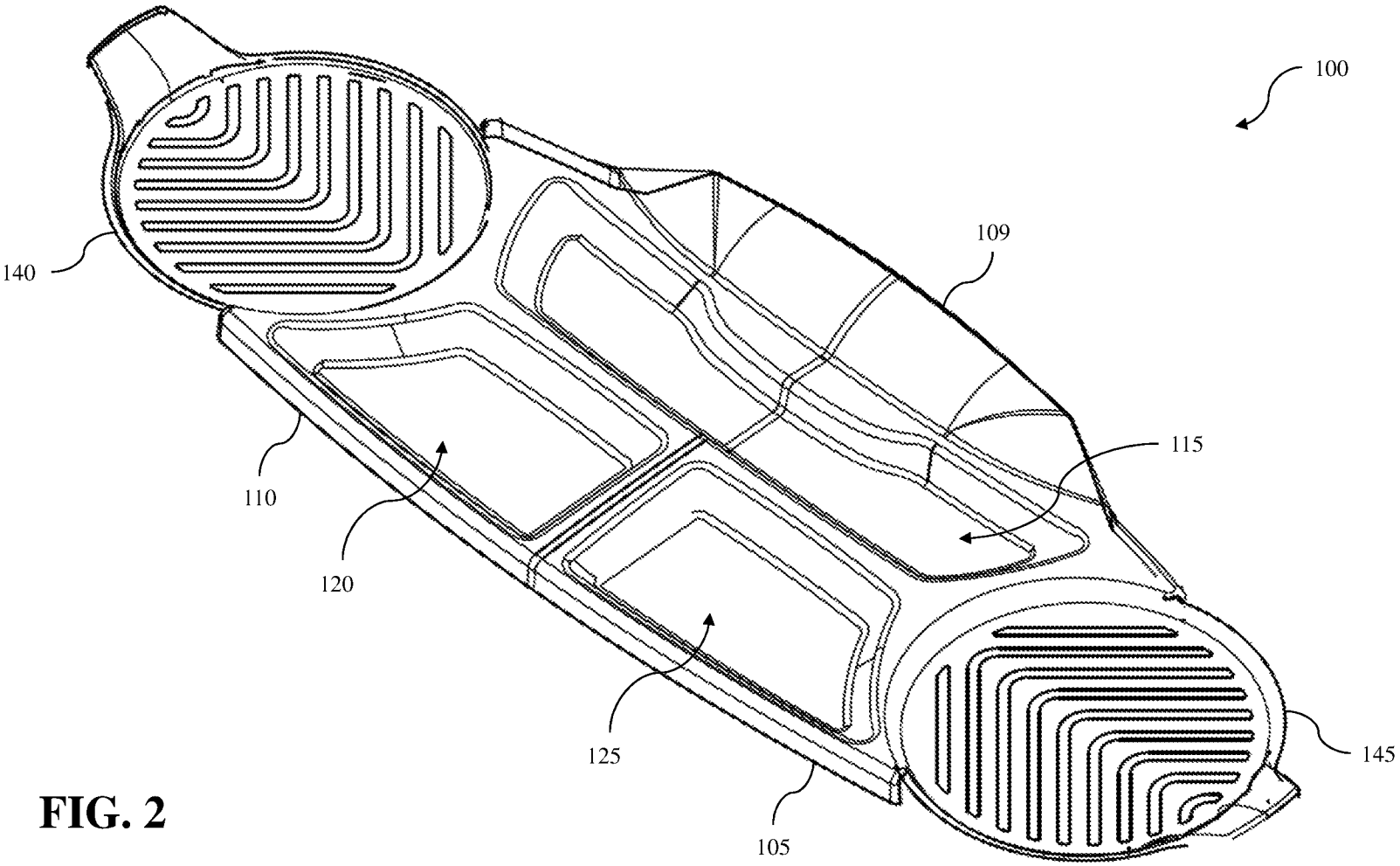
FIG. 2 is a perspective top view of an assembled beverage preparation apparatus, according to an example embodiment of the present invention.
Figure 3:
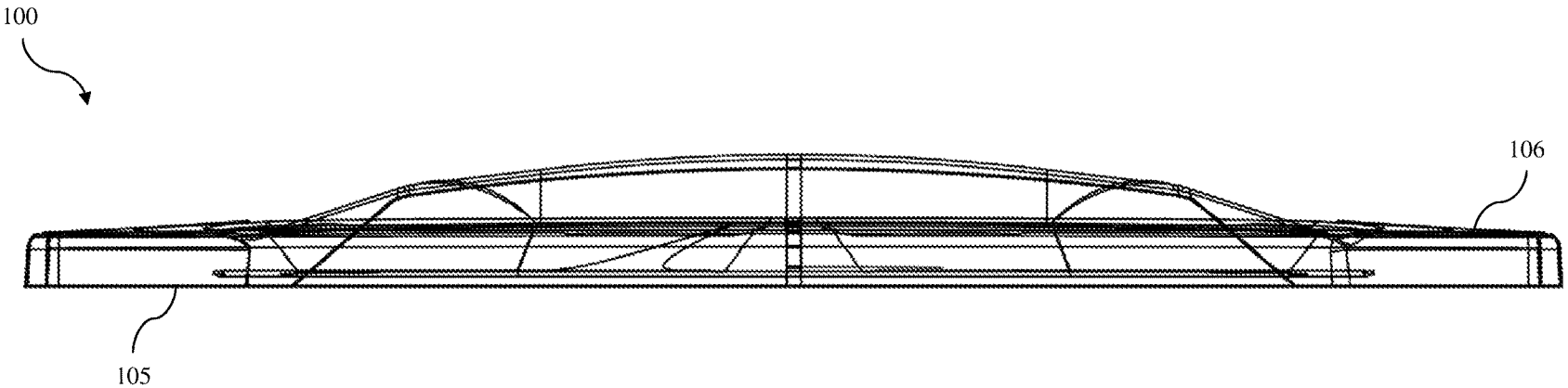
FIG. 3 is a rear view of an assembled beverage preparation apparatus, according to an example embodiment of the present invention.
Figure 4:
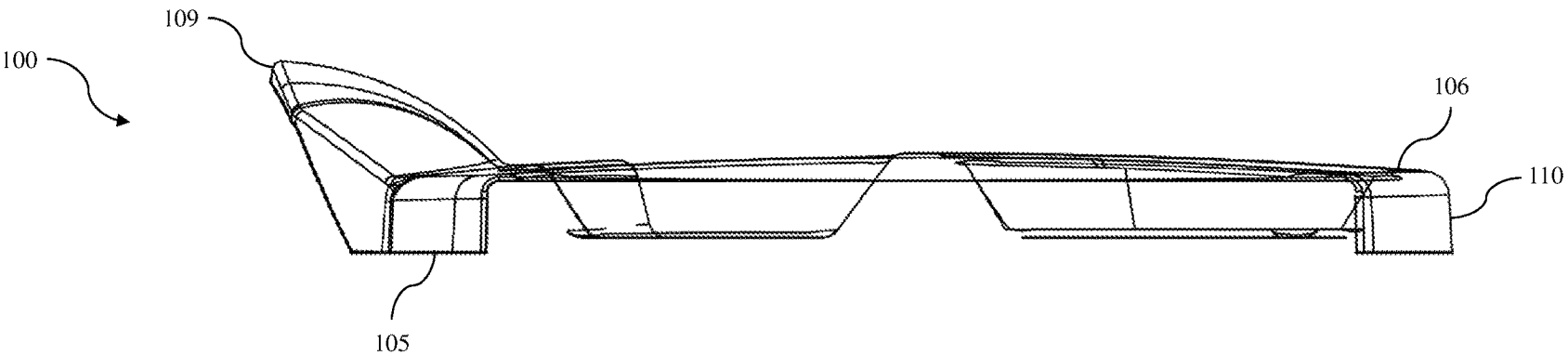
FIG. 4 is a side view of an assembled beverage preparation apparatus, according to an example embodiment of the present invention.
Figure 5:
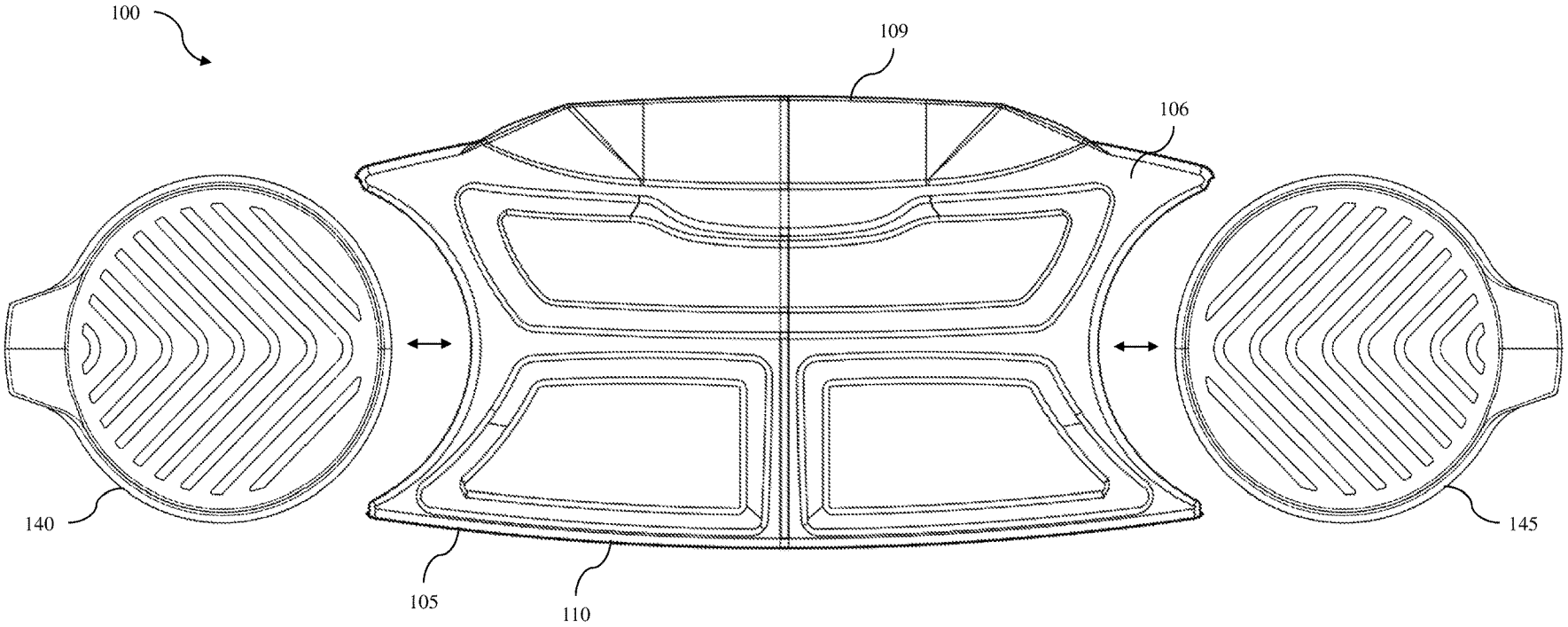
FIG. 5 is a top planar view of an unassembled beverage preparation apparatus, according to an example embodiment of the present invention.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions or modifications may be made to the elements illustrated in the drawings, and the methods described herein may be modified by substituting, reordering or adding additional stages or components to the disclosed methods and devices. Accordingly, the following detailed description does not limit the disclosed embodiments. Instead, the proper scope of the disclosed embodiments is defined by the appended claims.

The disclosed embodiments improve upon the prior art by providing a beverage preparation apparatus and kit that may be used in a commercial or private setting or at formal and informal functions and social gatherings in which beverages are served. The disclosed embodiments are designed to address the need for preparing a beverage in a clean and organized manner. The disclosed embodiments are configured to rest upon a planar surface to compartmentalize elements utilized in the process of preparing a beverage, such as a cup of tea or coffee. Unlike a typical serving tray, a user may easily lift the main tray of the apparatus that contains the refuse and runoff associated with the preparation process without disturbing the side trays or the beverage containers settled thereupon. The disclosed embodiments further improve upon the prior art by providing side trays with reduced points of contact, thereby reducing the likelihood of a beverage container being suctioned to the surface of the side trays. The disclosed embodiments also improve upon the prior art by providing a symmetrical design that is equally suitable for a right-handed or left-handed individual.

Referring now to the Figures, FIGS. 1-4 illustrate a beverage preparation apparatus 100 according to an example embodiment and will be discussed together for ease of reference. Although the examples given below describe a beverage preparation apparatus relative to coffee and tea, those of skill in the art will appreciate that the invention may be adapted for use with other beverages, including, but not limited to mixed alcoholic beverages, milkshakes, and root beer floats.

Figure 6:
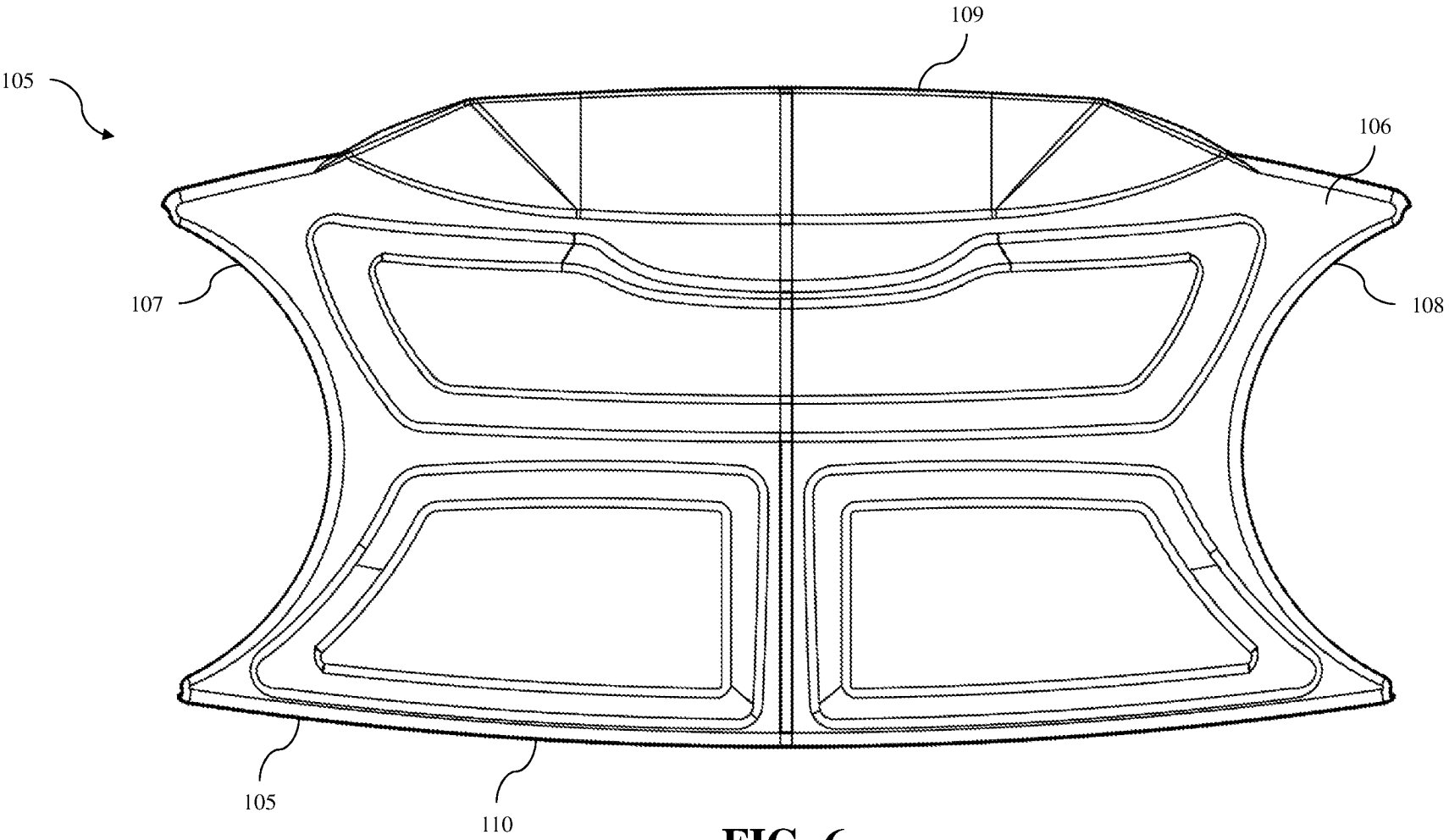
FIG. 6 is a top planar view of a main tray of a beverage preparation apparatus, according to an example embodiment of the present invention.

The beverage preparation apparatus 100 includes a main tray 105 comprising a an upward facing surface 106, a first side wall 107, a second side wall 108 (see FIG. 6), a first end portion 109, and second end portion 110. It should be appreciated that the planar shaped main tray 105 may have other shapes and dimensions, and such variations are within the spirit and scope of the claimed invention. The main tray 105 may be comprised of materials such as metals, ceramics, woods, and plastics that are waterproof or water resistant and dishwasher safe.

The main tray includes a first compartment 115. The first compartment is defined by a first set of a plurality of chamfered walls 116. The first set of the plurality of chamfered walls 116 are configured to reduce the drop impact of a liquid and the corresponding size of a splash such that the refuse and runoff associated with the preparation process may be contained and disposed of in an efficient manner. The first compartment is configured to provide a first containment area for allowing a user to store a utensil component (not shown) therein. As used herein, "utensil component" is meant to include utensils that are utilized during the process of preparing a cup of coffee and tea, such as spoons, stirrers, sticks, teaspoons, tablespoons, and the like. The first compartment is configured in a long, thin shape, so as to hold said utensil components. The first compartment 115 defines a substantially planar surface below from the upward facing surface 106 of the main tray. The first compartment is configured to capture the refuse and runoff associated with the preparation process.

In one embodiment, the first compartment 115 has a substantially rectangular shape that is integral with the main tray 105, so as to contain the utensil component. In one embodiment, the first compartment includes a ridge 117 protruding from the first set of the plurality of chamfered walls 116. The ridge is configured to maintain a utensil component in a stationary position to prevent the utensil component from shifting during movement of the main tray. For example, in one embodiment, the first compartment may be sized and shaped to store a teaspoon in a lengthwise configuration. In operation, the ridge of the first compartment prevents the teaspoon from sliding up and out from the inside of the first compartment when the main tray is in motion. It should be appreciated that the first compartment may include various shapes, sizes, and ridges, and such variations are within the spirit and scope of the claimed invention.

The main tray 105 further includes a second compartment 120. Similar to the first compartment, the second compartment is defined by a second set of a plurality of chamfered walls 121. As discussed above, the second set of the plurality of chamfered walls 121 are configured to reduce the drop impact of a liquid and the corresponding size of a splash such that the refuse and runoff associated with the preparation process may be contained and disposed of in an efficient manner. The second compartment is configured to provide a second containment area for allowing the user to store a beverage component (not shown) therein. As used herein, "beverage component" is meant to include primary ingredients, and additives that are utilized during the process of preparing a cup of coffee and tea, such as sugar, creamer, milk, honey, sugar packets, a slice of lemon or lime, honey containers, creamer containers, K-cups, and teabags, as well as the refuse and runoff associated with the preparation process. The second compartment is configured to hold said beverage components. The second compartment 120 defines a substantially planar surface below from the upward facing surface 106 of the main tray. In one embodiment, the second compartment has a substantially square shape that is integral with the main tray 105, however, it should be appreciated that the second compartment may include various shapes, sizes, and ridges, and such variations are within the spirit and scope of the claimed invention.

The main tray further includes a third compartment 125. Similar to the first 115 and second 120 compartments, the third compartment is defined by a third set of a plurality of chamfered walls 126 that are configured to reduce the drop impact of a liquid and the corresponding size of a splash such that the refuse and runoff associated with the preparation process may be contained and disposed of in an efficient manner. The third compartment is configured to provide a third containment area for allowing the user to store a beverage component (not shown) therein. The third compartment 120 defines a substantially planar surface below from the upward facing surface 106 of the main tray. In one embodiment, the third compartment has a substantially square shape that is integral with the main tray 105, however, it should be appreciated that the third compartment may include various shapes, sizes, and ridges, and such variations are within the spirit and scope of the claimed invention.

The first sidewall 107 of the main tray 105 is defined by a first curved element. In one embodiment, the first curved element comprises a semicircular body having a concave surface. The first sidewall 107 defines a first circumference that is greater than a second circumference of a first side tray such that a first end of the first side tray aligns flush against the first sidewall, as further discussed below. It should be appreciated that the first sidewall 107 may include additional shapes and sizes, and such variations are within the spirit and scope of the claimed invention.

The second sidewall 108 of the main tray is defined by a second curved element. In one embodiment, the second curved element comprises a semicircular body having a concave surface. The second sidewall 108 defines a third circumference that is greater than a fourth circumference of a second side tray such that a first end of the second side tray aligns flush against the second sidewall, as further discussed below. It should be appreciated that the second sidewall 108 may include additional shapes and sizes, and such variations are within the spirit and scope of the claimed invention.

Figure 7:
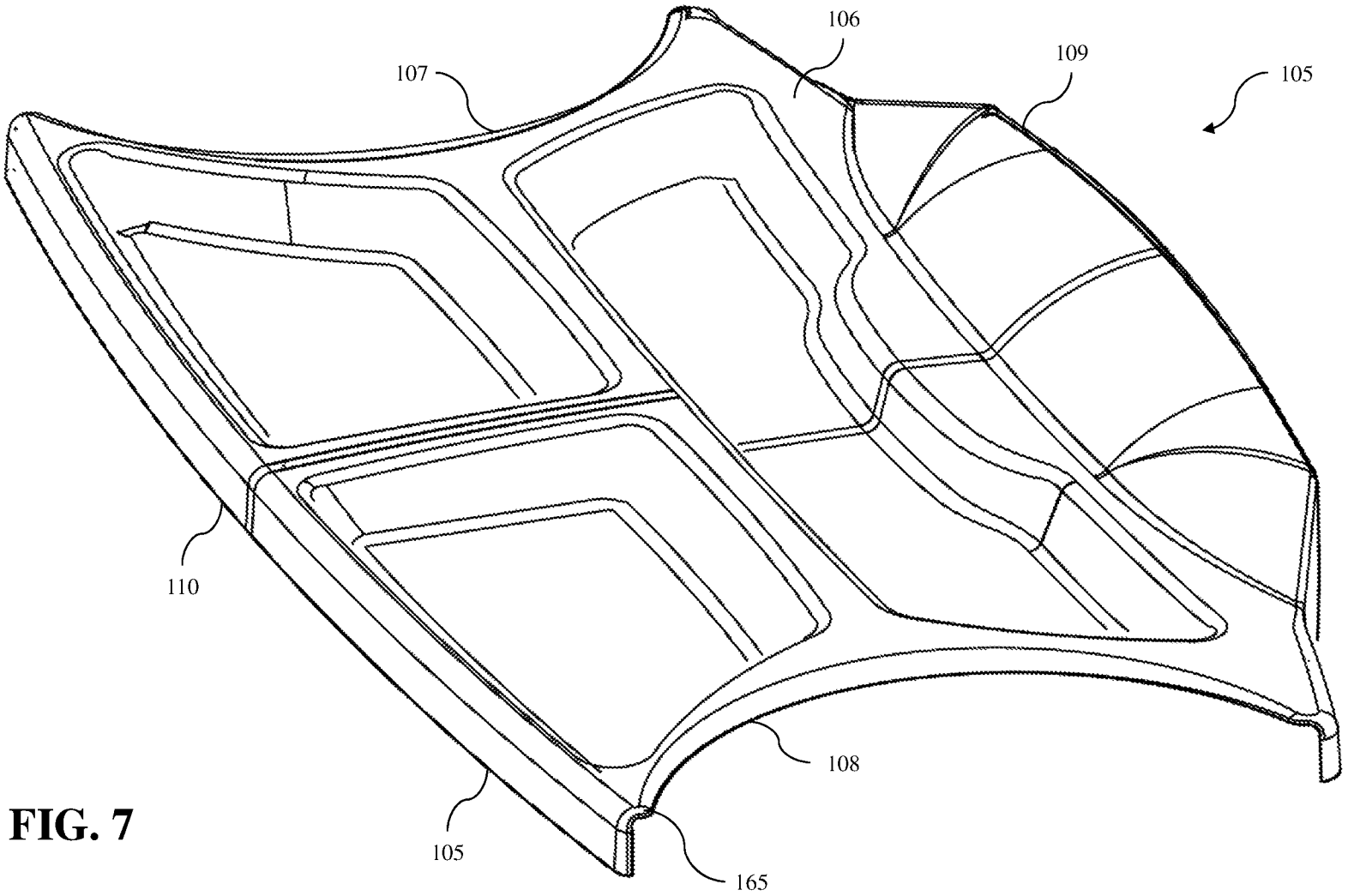
FIG. 7 is a perspective front side view of a main tray of a beverage preparation apparatus, according to an example embodiment of the present invention.
Figure 8:
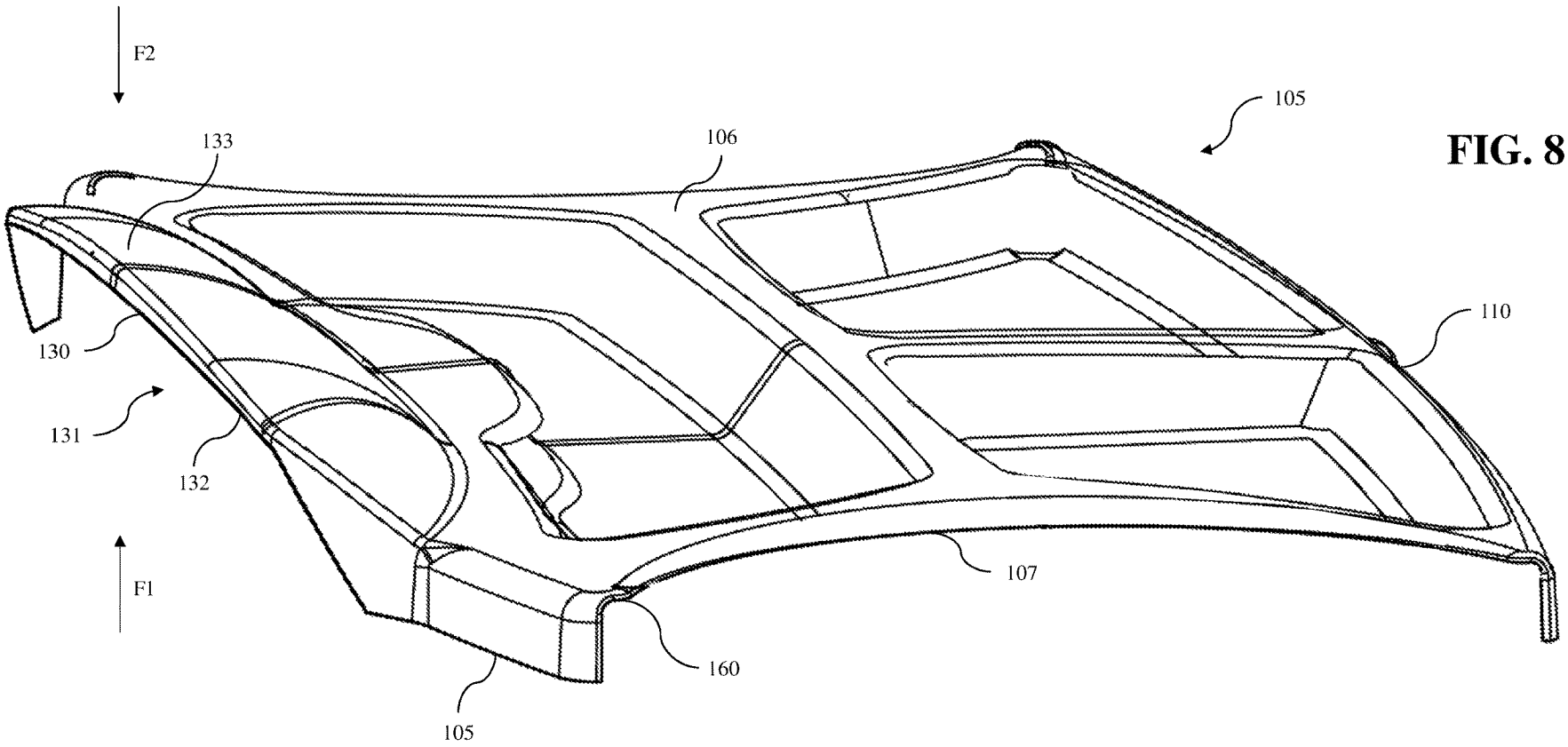
FIG. 8 is a perspective rear side view of a main tray of a beverage preparation apparatus, according to an example embodiment of the present invention.

The main tray 105 further includes a handle element 130 that is configured to facilitate the lifting and movement of the main tray off a surface and the washing or disposal of the waste on the main tray. As best shown in FIGS. 7 and 8, the handle element is defined by a curve shaped opening 131 located at the first end portion 109 of the main tray 105. In operation, the user inserts one or more fingers inside the curve shaped opening 131 to apply a first force (in the direction of arrowed line F1) on a downward facing surface 132 of the handle element 130. Simultaneously, the user grips the upward facing surface 133 of the handle element 130 with a downward facing palm such that the user's thumb applies a second force (in the direction of arrowed line F2) on the upward facing surface 133 of the handle element 130. Alternatively, depending on the orientation of the main tray, the user's thumb may apply a third force on a stem of a teaspoon, or other utensil component, located inside the first compartment to secure the utensil component in place.

Figure 10:
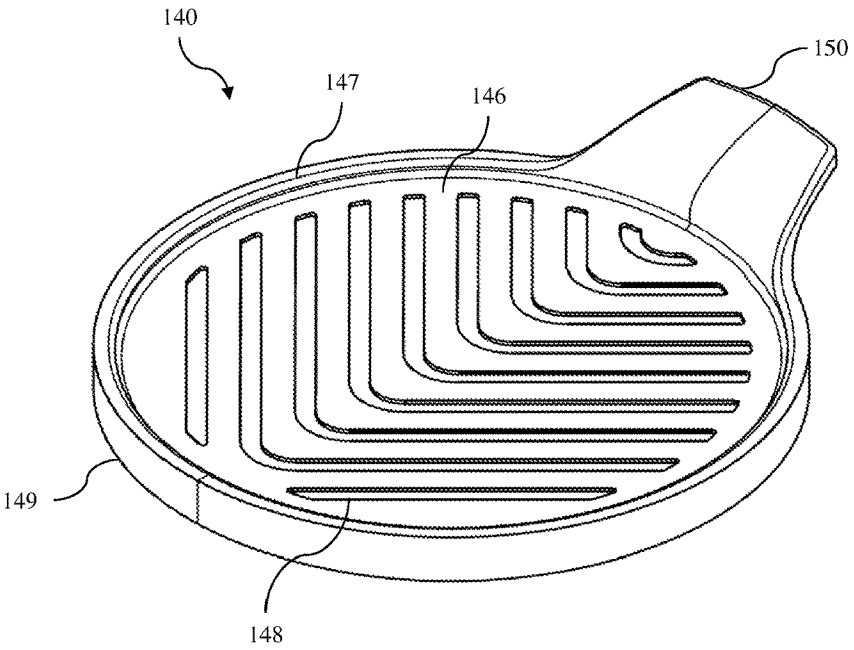
FIG. 10 is a perspective front view of a first side tray of a beverage preparation apparatus, according to an example embodiment of the present invention.
Figure 9:
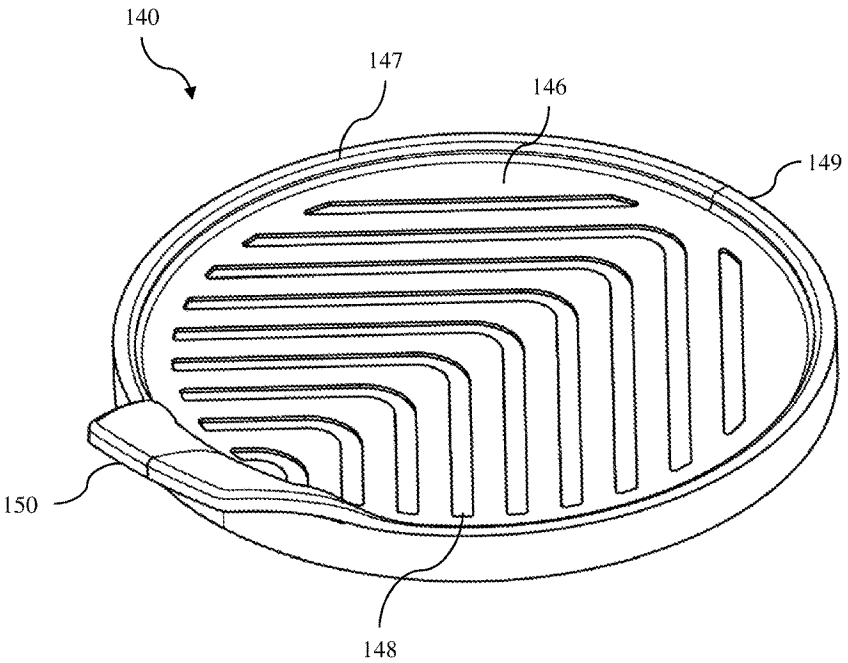
FIG. 9 is a perspective rear view of a first side tray of a beverage preparation apparatus, according to an example embodiment of the present invention.

FIGS. 9 and 10 are perspective rear and front views of a side tray of a beverage preparation apparatus, respectively, according to an example embodiment. The beverage preparation apparatus 100 includes a first side tray 140 for receiving a first beverage container (not shown) and a second side tray 145 for receiving a second beverage container (not shown). As used herein, "beverage container" may include cups, mugs, jars, cans, squeeze bottles, thermoses and cartons, and such variations that are within the spirit and scope of the claimed invention. In one embodiment, the beverage preparation apparatus 100 is part of a kit that includes a first beverage container and a second beverage container for use with the first and second side tray. It should be appreciated that each beverage container may have different functions, shapes, and sizes, and such variations are within the spirit and scope of the claimed invention.

In one embodiment, the first 140 and second side tray 145 comprise a circular shaped body that is sized and shaped according to the first and second curved element of the first 107 and second 108 sidewall of the main tray 105. The first 140 and second side tray 145 include a substantially planar upward facing surface 146 and an outer annular wall 147 extending upwardly therefrom. The outer annular wall 147 of the first 140 and second side tray 145 is configured to contain spilled runoff associated with the preparation process from leaking off the main tray and allow it to be disposed of in an efficient manner. The upward facing surface of the first 140 and second side tray 145 include a plurality of raised embossments 148. The plurality of raised embossments are configured to reduce potential points of contact with the beverage container placed on the upward facing surface of the first 140 and second side tray 145 to prevent the beverage container from creating a suction force on the upward facing surface of the first 140 and second side tray 145. It should be appreciated that the first 140 and second side tray 145 may include various shapes and sizes, and such variations are within the spirit and scope of the claimed invention.

The upward facing surface of the first 140 and second side tray 145 include a tab 150 extending outwardly and upwardly therefrom for moving the first 140 and second side tray 145 independently from the main tray. As discussed above, in operation, the first 140 and second side tray 145 are configured to removably connect to the first 107 and second 108 sidewall of the main tray, respectively. As best shown in FIGS. 7 and 8, the first and second sidewall include a first 160 and second 165 outwardly extending semi-annular flange. Each outwardly extending semi-annular flange is configured to rest above the upward facing surface of a first end 149 of the first 140 and second side tray 145 such that a gapless connection is formed to prevent runoff associated with the preparation process from leaking between the first 140 and second side tray 145 and the first 107 and second 108 sidewall.

Regarding the feature wherein the side trays are configured to removably connect to the sidewalls of the main tray, the beverage preparation apparatus 100 and its components are modular. That is, the beverage preparation apparatus 100 and its components are designed with standard units that can be fit together in a variety of ways. The beverage preparation apparatus 100 and its components consist of separate parts that each can act alone, but that can be combined in a variety of ways to form one tray.

The beverage preparation apparatus 100 and its components may be manufactured from a variety of materials including plastic, rubber, and metal, such as stainless steel, titanium, aluminum or any metal alloy, rigid fabric, carbon fiber, epoxy resin, graphite, or any combination of the above. Plastic covers a range of synthetic or semi-synthetic polymerization products. Plastics are composed of organic condensation or addition polymers and may contain other substances to improve performance or economics. In the claimed subject matter, plastic may comprise any one or more of the following forms of plastic: polyethylene, polycarbonate, polystyrene, high impact polystyrene, polyethylene terephthalate, nylon, polypropylene, acrylonitrile butadiene styrene (ABS), bayblend and polyvinylidene chloride (PVC).

The beverage preparation apparatus 100 and its components may be manufactured from a plastic compound using any variety of processes, such as injection molding, fusible core injection molding and thermoforming. Injection molding is a manufacturing technique for making parts from thermoplastic material in production. The most commonly used thermoplastic materials are polystyrene, polycarbonate, ABS or acrylonitrile butadiene styrene, nylon, polypropylene, polyethylene, and polyvinyl chloride or PVC. Fusible core injection molding or lost core injection molding is a specialized plastic injection molding process. Thermoforming is a manufacturing process for thermoplastic sheet or film.

In one embodiment, the beverage preparation apparatus 100 and its components may be manufactured from a material that is a solid color (or multiple solid colors), a transparent color (or multiple transparent colors) or may include a pattern or other series of multiple colors in a variety of selections. In another embodiment, the beverage preparation apparatus 100 and its components may include graphics, designs, logos, pictures, or any images that can be applied to the planar sheets. The graphics may be embedded in the material comprising the beverage preparation apparatus 100 and its components or the graphics may be stamped, painted, stenciled, laser etched, printed, engraved or silk-screened onto the exterior or interior surfaces of the planar sheets.

In one embodiment, the beverage preparation apparatus 100 and its components may be manufactured from a material that dissipates or insulates the heat created by the coffee or tea during use. The material used to manufacture the beverage preparation apparatus 100 and its components, such as plastic, may possess heat isolative properties that prevent the outside surface of the device from overheating. Alternatively, the material used to manufacture the beverage preparation apparatus 100 and its components may possess any combination of heat insulating and heat conducting properties so as to accomplish the goal of re-directing the heat emanating from the coffee or tea. Such redirection of the heat is beneficial as it reduces or eliminates the negative implications of high temperatures, including overheating or burning of a person's skin or a fragile table when contacting said beverage preparation apparatus 100.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

We claim:

1. A beverage preparation apparatus comprising:

a main tray comprising:

a first compartment defined by a first set of a plurality of chamfered walls, wherein the first compartment is configured to provide a first containment area for allowing a user to store a utensil component therein;

a second compartment defined by a second set of a plurality of chamfered walls, wherein the second compartment is configured to provide a second containment area for allowing the user to store a first beverage component therein;

a third compartment defined by a third set of a plurality of chamfered walls, wherein the third compartment is configured to provide a third containment area for allowing the user to store a second beverage component therein;

a first sidewall defined by a first curved element;

a second sidewall defined by a second curved element;

a handle element;

a first side tray for receiving a first beverage container, wherein the first side tray is configured to removably connect to the first sidewall of the main tray; and a second side tray for receiving a second beverage container, wherein the second side tray is configured to removably connect to the second sidewall of the main tray.

2. The apparatus of claim 1, wherein the first sidewall defines a first circumference that is greater than a second circumference of the first side tray such that a first end of the first side tray aligns flush against the first sidewall.

3. The apparatus of claim 1, wherein the second sidewall defines a third circumference that is greater than a fourth circumference of the second side tray such that a first end of the second side tray aligns flush against the second sidewall.

4. The apparatus of claim 1, wherein the first sidewall includes a first outwardly extending semi-annular flange configured to rest above an upward facing surface of the first end of the first side tray such that a gapless connection is formed therein.

5. The apparatus of claim 1, wherein the second sidewall includes a second outwardly extending semi-annular flange configured to rest above an upward facing surface of a first end of the second side tray such that a gapless connection is formed therein.

6. The apparatus of claim 1, wherein the first compartment includes a ridge configured to maintain a utensil component in a stationary position to prevent the utensil component from shifting during movement of the main tray.

7. The apparatus of claim 1, wherein the handle element is defined by an arched opening at a first end portion of the main tray, the handle element configured for gripping and moving the main tray independent of the first side tray and the second side tray.

8. The apparatus of claim 1, wherein an upward facing surface of each side tray includes a plurality of raised embossments configured to reduce contact points with a beverage container.

9. The apparatus of claim 8, wherein the upward facing surface of each side tray includes a tab extending outwardly and upwardly therefrom for moving each side tray independent of the main tray.

10. The apparatus of claim 9, wherein the upward facing surface of each side tray includes an outer annular wall extending upwardly therefrom.

11. A beverage preparation kit comprising:

a main tray comprising:

a first compartment configured to provide a first containment area for allowing a user to store a utensil component therein;

a second compartment configured to provide a second containment area for allowing the user to store a first beverage component therein;

a third compartment configured to provide a third containment area for allowing the user to store a second beverage component therein;

a first sidewall;

a second sidewall;

a handle element;

a first beverage container;

a first side tray for receiving the first beverage container, wherein the first side tray is configured to removably connect to the first sidewall of the main tray;

a second beverage container; and a second side tray for receiving the second beverage container, wherein the second side tray is configured to removably connect to the second sidewall of the main tray.

12. The kit of claim 11, wherein the first sidewall defines a curved element having a first circumference that is greater than a second circumference of the first side tray such that a first end of the first side tray aligns flush against the first sidewall.

13. The kit of claim 11, wherein the second sidewall defines a curved element having a third circumference that is greater than a fourth circumference of the second side tray such that a first end of the second side tray aligns flush against the second sidewall.

14. The kit of claim 11, wherein the first sidewall includes a first outwardly extending semi-annular flange configured to rest above an upward facing surface of the first end of the first side tray such that a gapless connection is formed therein.

15. The kit of claim 11, wherein the second sidewall includes a second outwardly extending semi-annular flange configured to rest above an upward facing surface of a first end of the second side tray such that a gapless connection is formed therein.

16. The kit of claim 11, wherein the first compartment includes a ridge configured to maintain the utensil component in a stationary position to prevent the utensil component from shifting during movement of the main tray.

17. The kit of claim 11, wherein the handle element is defined by an arched opening at a first end portion of the main tray, the handle element configured for moving the main tray independent of the first side tray and the second side tray.

18. The kit of claim 11, wherein an upward facing surface of each side tray includes a plurality of raised embossments configured to reduce contact points with a beverage container.

19. The kit of claim 18, wherein the upward facing surface of each side tray includes an outer annular wall extending upwardly therefrom.

20. A beverage preparation apparatus comprising:

a main tray comprising:

at least one compartment, at least one sidewall;

a handle element;

at least one side tray for receiving at least one beverage container;

wherein at least one compartment is configured to provide at least one containment area for allowing a user to store at least one beverage component or utensil component therein;

wherein the at least one sidewall defines a first circumference that is greater than a second circumference of the at least one side tray such that a first end of the at least one side tray aligns flush against the at least one sidewall;

wherein the at least one sidewall includes an outwardly extending semi-annular flange configured to rest above an upward facing surface of the first end of the at least one side tray such that a gapless connection is formed therein;

wherein the handle element is defined by an arched opening at a first end portion of the main tray, the handle element configured for gripping and moving the main tray independent of the at least one side tray; and wherein an upward facing surface of the at least one side tray includes a tab extending outwardly and upwardly therefrom for moving the side tray independent of the main tray.

* * * * *